United States Patent [19]

Fuchs et al.

[11] Patent Number: 4,959,129

[45] Date of Patent: Sep. 25, 1990

[54] CONTINUOUS PLATING METHOD AND APPARATUS

[75] Inventors: Harold E. Fuchs; Robert E. McAnany, both of Kansas City, Mo.

[73] Assignee: AT&T Bell Laboratories, Murray Hill, N.J.

[21] Appl. No.: 355,708

[22] Filed: May 23, 1989

[51] Int. Cl.[5] ..... C25D 7/06; C25D 17/00

[52] U.S. Cl. ..... 204/28; 204/206

[58] Field of Search ..... 204/28, 206

[56] References Cited

U.S. PATENT DOCUMENTS

| | | | |
|---|---|---|---|
| 830,093 | 9/1906 | Meaker | 204/206 |
| 4,105,526 | 8/1986 | Lewellen, Jr. et al. | 204/213 |
| 4,680,099 | 7/1987 | Singleton | 204/213 |

*Primary Examiner*—T. M. Tufariello

*Attorney, Agent, or Firm*—Lester H. Birnbaum

[57] ABSTRACT

Disclosed is a method and apparatus for plating metal onto wire or ribbon. The wire or ribbon is wrapped around two or more barrels with grooves formed around the outside surface. The barrel is immersed within an appropriate electroless or electroplating solution, and rotated at a speed depending upon the immersion time needed for a particular desired plated thickness.

16 Claims, 4 Drawing Sheets

CONTINUOUS PLATING METHOD AND APPARATUS

BACKGROUND OF THE INVENTION

This invention relates to plating of long articles such as circular wire or flattened ribbon.

There is currently a need for continuous plating of articles such as wires or ribbons. For example, copper wire is frequently electroplated with tin for assembling into cables. Flattened ribbons of material such as iron-nickel alloy may need to be coated with a layer such as nickel by an electroless operation. Such ribbon, when cut into appropriate sized members, can be used, for example, as the armature of mercury-wetted relays.

Whether an electroless or electroplating operation is employed, the article to be plated is usually provided on a spool and then drawn out into a long trough which includes the desired plating solution. The troughs need to be long (typically 100–200 ft.) so that the article is immersed for a sufficient time to achieve the necessary thickness. The major disadvantage of such apparatus is that they use up a great deal of factory space. It would be more economical if the coating operation could be performed within a more confined space.

SUMMARY OF THE INVENTION

This and other objects are achieved in accordance with the invention which, in one aspect, is a method for plating an elongated article. The article is wrapped around at least a portion of the outer surface of an essentially cylindrical member to form a plurality of loops. The member is rotated at a prescribed speed while the member and article are immersed within a plating solution so as to control the thickness of plating on the article.

In accordance with another aspect, the invention is an apparatus for plating an elongated article. The apparatus includes an essentially cylindrical member with an outer surface adapted for receiving a plurality of loops of the article thereon. The apparatus further includes a container suitable for holding a plating solution therein, the cylindrical member being mounted within the container. Also included are means for rotating the cylindrical member at a prescribed speed in order to control the thickness of a plated layer on said article.

BRIEF DESCRIPTION OF THE DRAWING

These and other features of the invention are delineated in detail in the following description. In the drawing.

It will be appreciated that, for purpose of illustration, these figures are not necessarily drawn to scale.

DETAILED DESCRIPTION

Figure 1:
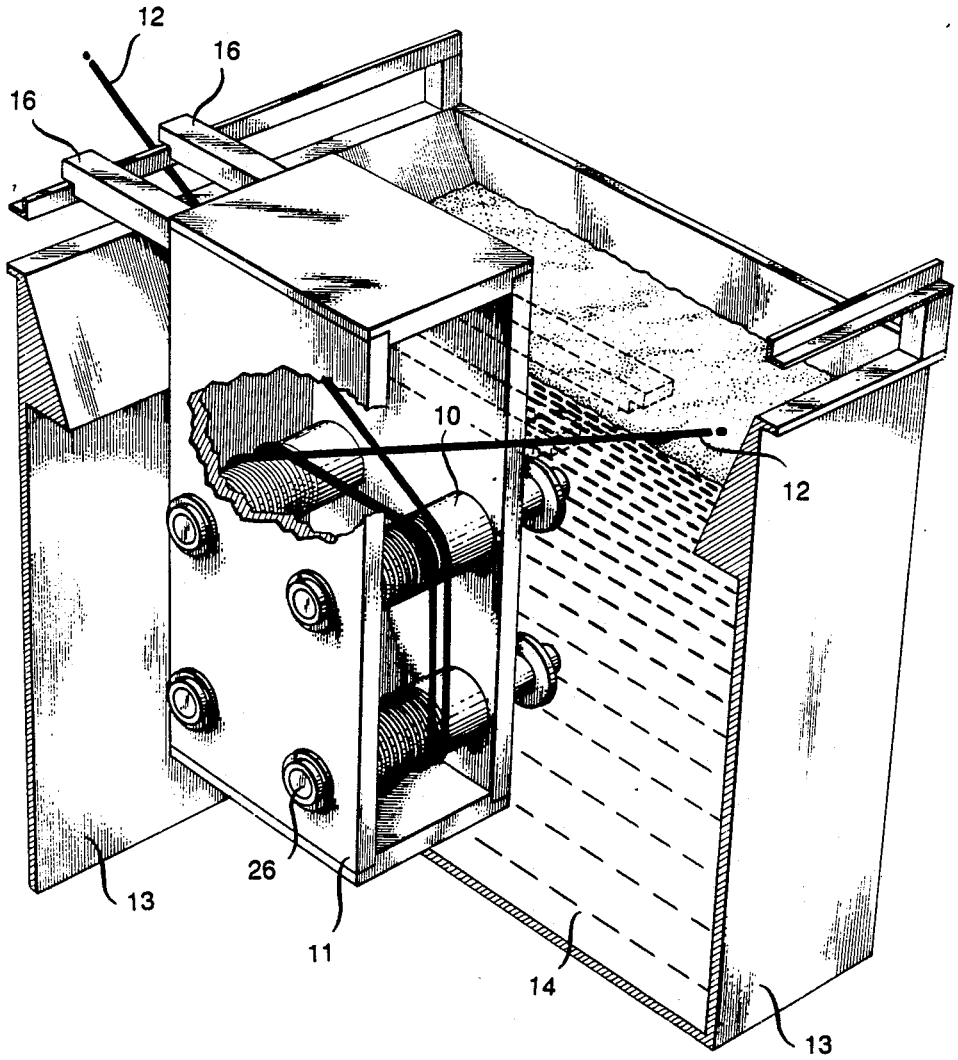
FIG. 1 is a perspective partly cutaway view of a portion of an apparatus in accordance with one embodiment of the invention.

The basic elements of the invention are described with reference to FIGS. 1 and 2. A plurality of essentially cylindrical elements in this example four barrels such as 10, are rotatably mounted within a suitable frame, 11. Typically, the barrels and frame would be made of materials which are thermally and chemically stable in the plating solution, such as polypropylene and chloropolyvinylchloride. The barrels in this particular example measure approximately 2 inches in diameter and the frame measures approximately 4"×8"×18". The elongated article to be plated, in this example a metal ribbon 12, is wrapped around the outer surfaces of the barrels several times to form rectangular loops. (Only two loops are shown in FIG. 1 for clarity.) The ribbon, 12, is typically provided on a spool and also collected on another spool (not shown in FIG. 1). The frame, 11, is inserted within a container 13 so that at least the portion including the barrels is immersed in a plating solution 14. In this particular example, the solution is a standard electroless plating bath such as an acid nickel phosphorous bath.

Figure 2:
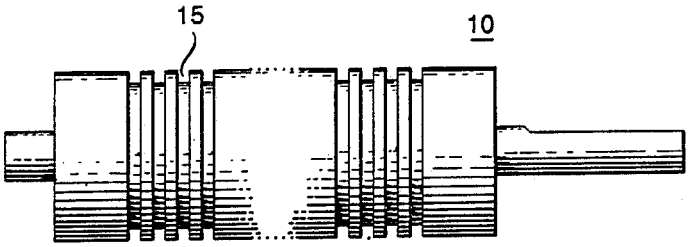
FIG. 2 is a more detailed illustration of a portion of the apparatus of FIG. 1.

FIG. 2 illustrates in more detail one of the barrels 10. It will be noted that the outer surface of the cylindrical element includes a series of parallel grooves, such as 15, to accommodate the ribbon to be plated (not shown in this view). The entrance end for the ribbon is assumed to be left hand side and the exit end is the right hand portion of the cylinder. The groove is formed by standard means such as machining to a depth of approximately 1.25 mm. Actually, it is preferred to have the groove depth at the entrance end slightly less than that of the exit end to create the right tension on the ribbon to avoid sagging.

In order to advance the ribbon over the barrels, the positions of the grooves in each barrel are offset with respect to the grooves in an adjacent barrel in the path of the ribbon by an amount of $\frac{1}{4}$ times the groove pitch. Thus, in this example, the groove pitch (distance between adjacent grooves on a barrel) was 2.5 mm, and therefore the grooves on an adjacent barrel would be offset by 0.625 mm.

Figure 3:
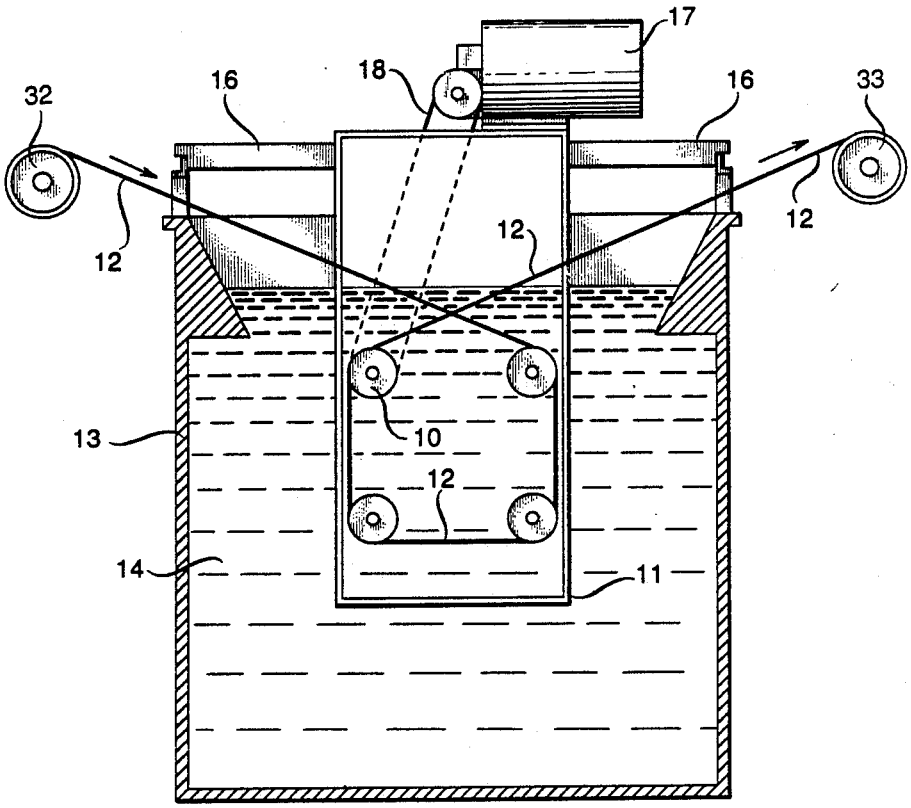
FIGS. 3 and 4 are front and side views, respectively, of a more detailed version of the apparatus according to FIG. 1.
Figure 4:
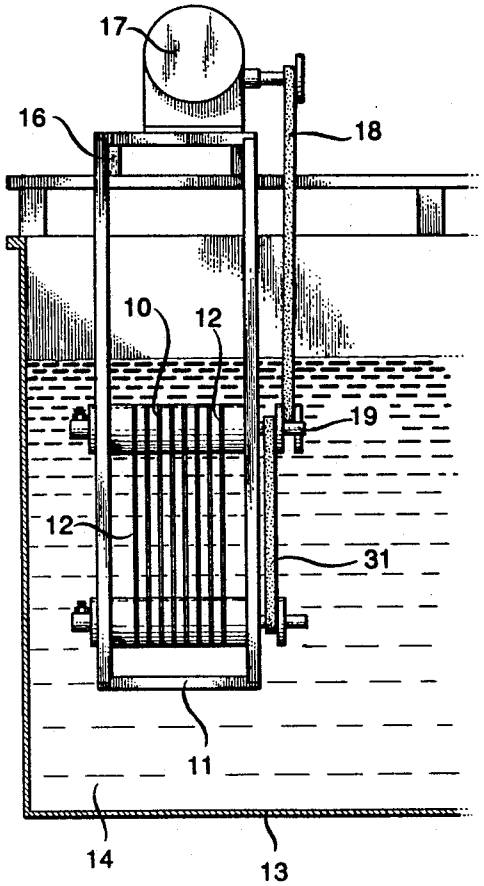

FIGS. 3 and 4 illustrate a more detail version of the apparatus of FIG. 1, with corresponding elements being similarly numbered. It will be noted that the frame is mounted to a flange, 16, which rests upon the top surface of the container 13. The frame, 11, includes a horizontal portion on which is mounted a drive motor, 17. The motor is a standard, commercially available type such as that sold by Bodine Inc. The motor is mechanically coupled to at least one of the barrels, 10, by means of a drive chain 18 extending from the drive shaft of the motor to a sprocket, 19. The sprocket, 19, is coupled to one of the barrels, 10, but extends outside the frame 11. An additional drive chain, 31 of FIG. 4, mechanically couples barrel 10 to the other barrels (this chain is omitted from FIG. 3 for the sake of clarity in the illustration).

In order to plate a strip such as 12, it is unwound from a spool 32, threaded through the grooves on the barrels, and the forward end is coupled to another spool 33. The barrels with the strip wound around them are immersed in the plating bath. The barrels are rotated at a prescribed speed so that each portion of the strip will remain immersed in the bath for the correct amount of time to produce the desired plated thickness. Tension is provided to the strip by the rotation of the spool 33 to which the forward end of the strip is attached. An electroless plating of the strip to a desired thickness is therefore effected in a very compact space.

In one example, a metal ribbon comprising a nickel iron alloy was wound around the barrels approximately 24 times and immersed in a bath comprising an acid nickel phosphorous in order to electroless plate a nickel coating on the ribbon. The barrels were rotated at a speed of 38 RPM so that each portion of the ribbon would remain in the solution for approximately 15 minutes. This produced a coating on the ribbon of approximately 4 microns as it emerged from the solution and was wound on the output spool.

It will be appreciated that, although four barrels are shown in this embodiment, the invention can also be practiced with any plurality of barrels depending on particular needs.

Figure 6:
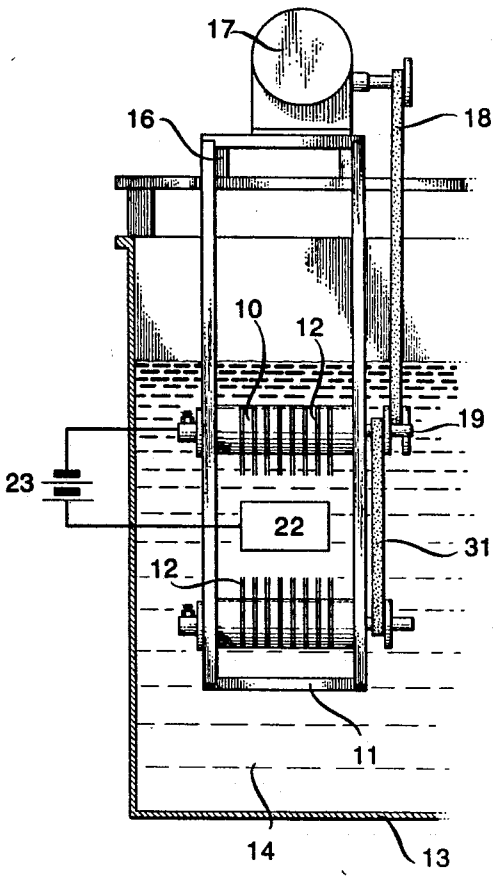
FIGS. 5 and 6 are front and side views, respectively, of an apparatus in accordance with a further embodiment of the invention.
Figure 5:
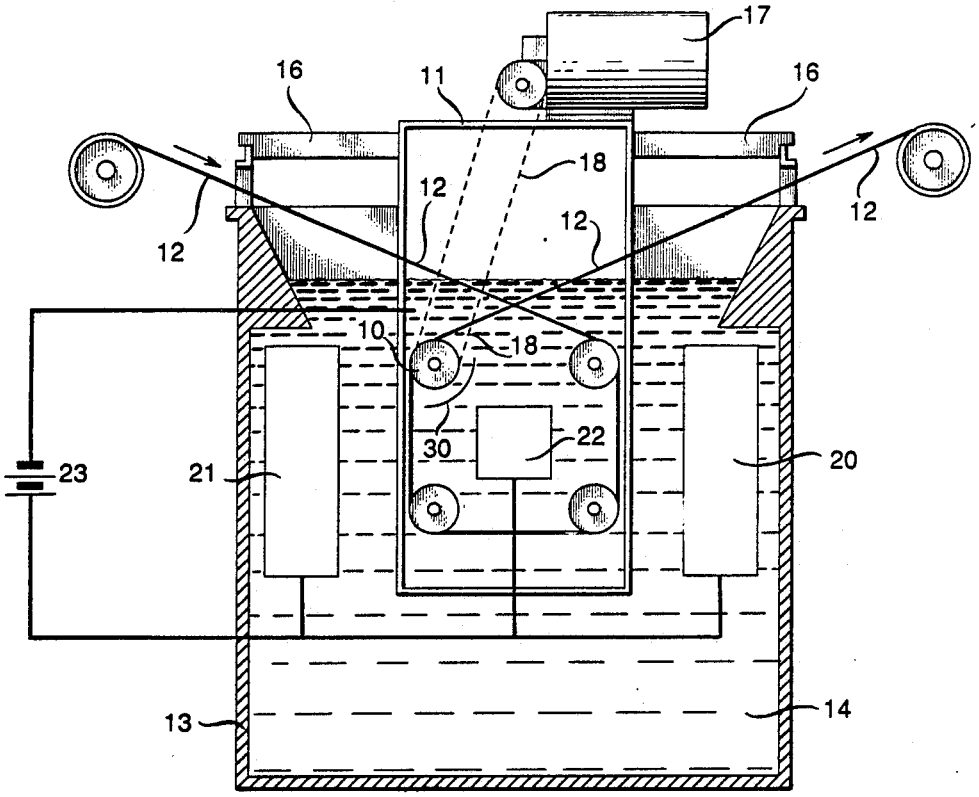
Figure 7:
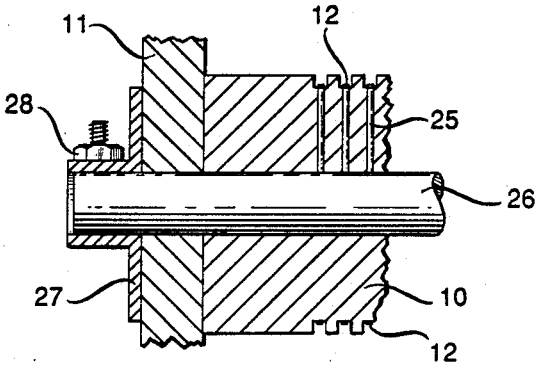
FIG. 7 is an enlarged view of a portion of the apparatus of FIGS. 5 and 6.

FIGS. 5,6 and 7 illustrate in partly schematic form an apparatus in accordance with a further embodiment of the invention which is suitable for electroplating a layer onto a strip. Elements which are essentially the same as those shown in FIGS. 1–4 are similarly numbered. Anodes 20 and 21 are positioned within the bath so as to plate the outer surface of the strip, while anode 22 is positioned in the interior of the frame in order to plate the inner surface of the strip (ribbon 12 is cut away in FIG. 6 to view cathode 22 and, again, drive train 31 is omitted from FIG. 5 for clarity). A negative potential is applied by a standard dc source, 23, to the strip 12 through one of the barrels 10. The means for providing this electrical connection are shown in FIG. 7 which is an enlarged cross-sectional view of a portion of FIG. 6. The barrel 10, is formed with a cylindrical conductive core, 26, which extends to the outside of the frame 11. A plurality of conductive pins, such as 25, are inserted in holes in the barrel 10 which extend from the surface of the grooves to the conductive rod 26. A conductive ring 27 is formed on the outside of the frame 11 and makes slidable contact with the rod 26. Thus, when a wire from dc source 23 is attached to lug 28, a negative bias is maintained on the strip 12 as the barrels rotate. Immersion of the frame in an appropriate electroplating bath, therefore, results in plating of the strip surface. The thickness of the plated layer is, again, dependent upon the time of immersion of the strip which is, in turn, dependent upon the speed of rotation of the barrels and the current density. In order to prevent the pins, 25, from being plated, a shield 30 of FIG. 5, is provided between the barrel 10 and anode 22.

It will be appreciated in this embodiment, that any number of pins, 25, may be provided for contacting the strip 12, such pins need not be formed in each groove surface.

It will also be noted that further variations of the basic invention are possible. For example, while mechanical means have been provided for rotating the barrels, the tension provided by the take-up reel may be sufficient by itself to produce the desired rotation. Further, any number of barrels may be employed. In the general case, therefore, in order to advance the strip, the position of the grooves of the barrels will preferably be offset by an amount of 1/n times the groove pitch, where n equals the number of barrels.

Various additional modifications will become apparent to those skilled in the art. All such variations which basically rely on the teachings through which the invention has advanced the art are properly considered within the scope of the invention.

We claim:

1. A method for plating an elongated article comprising:

wrapping the article around a plurality of essentially cylindrical members to form a plurality of loops, each cylindrical member including a plurality of grooves of varying depths in its outer surface in which the article is positioned;

completely immersing the members within a plating solution; and rotating the members at a prescribed speed while said members and article are immersed within the plating solution so as to control the thickness of plating on said article.

2. The method according to claim 1 wherein the plating solution is an electroless plating solution.

3. The method according to claim 1 wherein the solution is an electroplating solution and the method includes applying an electrical bias to said article.

4. The method according to claim 3 wherein the electrical bias is supplied through at least one of said cylindrical members.

5. The method according to claim 1 wherein the member is rotated by means of a motor mechanically coupled to said member.

6. The method according to claim 1 wherein the article is selected from the group consisting of electrical wire and metal ribbon.

7. The method according to claim 1 wherein the positions of grooves of each member are offset with respect to those of an adjacent member by an amount of 1/n times the separation of the grooves in a member, where n is the number of members.

8. The method according to claim 1 wherein the article is provided on a first reel and after being wrapped around said members is collected on a second reel.

9. The method according to claim 4 wherein the electrical bias is supplied through a conductive core portion of said cylindrical member and a plurality of conductive pins extending from the core to the grooves.

10. Apparatus for plating an elongated article comprising:

a plurality of essentially cylindrical members each with an outer space including a plurality of grooves of varying depths adapted for receiving the article therein;

a container suitable for holding a plating solution therein, said cylindrical members mounted within the container so as to be completely immersed in the solution; and means for rotating said cylindrical members at a prescribed speed in order to control the thickness of a plated layer on said article.

11. The apparatus according to claim 10 wherein the positions of the grooves of each member are offset with respect to an adjacent member by an amount of 1/n times the distance between adjacent grooves on a member, where n equals the number of members.

12. The apparatus according to claim 10 wherein the means for rotating the member comprises a motor mechanically coupled to said member.

13. The apparatus according to claim 10 further comprising an electrode positioned within said container so as to permit electroplating of the surface of the article.

14. The apparatus according to claim 13 further comprising means for electrically biasing the article.

15. The apparatus according to claim 14 wherein the biasing means includes a conductive core portion of at least one of the cylindrical member and a plurality of conductive pins extending from the core to the outer surface of the member so as to make contact with the article.

16. The apparatus according to claim 15 further comprising a shield located between said cylindrical member and said electrode to prevent plating of said pins.

* * * * *

UNITED STATES PATENT AND TRADEMARK OFFICE

CERTIFICATE OF CORRECTION

PATENT NO. : 4,959,129

DATED : September 25, 1990

INVENTOR(S) : Harold E. Fuchs and Robert E. McAnany

It is certified that error appears in the above-identified patent and that said Letters Patent is hereby corrected as shown below:

Column 1, line 64, "invention," should read --invention;--. Column 2, line 5, "elements in" should read --elements, in--; line 29, "to be left" should read --to be the left--; line 44, "more detail" should read --more detailed--. Column 3, line 52, "such pins" should read --and such pins--. Column 4, line 46, "an outer space" should read --an outer surface--. Column 5, line 3, "member" should read --members--.

Signed and Sealed this

Nineteenth Day of May, 1992

*Attest:*

DOUGLAS B. COMER

*Attesting Officer*

*Acting Commissioner of Patents and Trademarks*